US006431517B1

(12) United States Patent
Chapman

(10) Patent No.: US 6,431,517 B1
(45) Date of Patent: Aug. 13, 2002

(54) REUSABLE GRIPPER/STABILIZER JIG FOR CONSTRUCTION ANCHOR BOLT

(76) Inventor: Grant S. Chapman, 817 Mt. Adams Ave., Boardman, OR (US) 97818

( * ) Notice: Subject to any disclaimer, the term of this patent is extended or adjusted under 35 U.S.C. 154(b) by 0 days.

(21) Appl. No.: 09/684,594

(22) Filed: Oct. 5, 2000

(51) Int. Cl.[7] ..... F04B 1/38

(52) U.S. Cl. ..... 249/93; 249/91; 52/699; 52/700

(58) Field of Search ..... 52/699, 700, 704, 52/DIG. 1, 301, 300; 249/91, 93, 190

(56) References Cited

U.S. PATENT DOCUMENTS 3,552,734 A 1/1971 Encino
3,960,356 A 6/1976 Adams
4,932,818 A 6/1990 Garwood
5,060,436 A 10/1991 Delgado, Jr.
5,240,224 A 8/1993 Adams
5,813,188 A 9/1998 Behlen

*Primary Examiner*—Beth A. Stephan
*Assistant Examiner*—Patrick J. Chavez
(74) *Attorney, Agent, or Firm*—Kolisch Hartwell Dickinson McCormack & Heuser

(57) ABSTRACT

A releasable jig for positioning and stabilizing while properly orienting an anchor bolt during construction where such a bolt is placed in wet, curing concrete. The jig includes a tube-like portion which is slightly tapered to effect a friction grip on such a bolt, and this tube-like portion includes a slot-like opening which exposes the outer, upper end extremity of a bolt so that the position of this end extremity can clearly be seen during installation.

11 Claims, 4 Drawing Sheets

REUSABLE GRIPPER/STABILIZER JIG FOR CONSTRUCTION ANCHOR BOLT

BACKGROUND AND SUMMARY OF THE INVENTION

This invention relates to a building construction tool, and more particularly to a jig (also referred to herein as a gripper/stabilizer) which can be used and reused many times in construction projects for the purpose of gripping, stabilizing and properly positioning a stem-wall anchor bolt in a wet, curing building material, such as concrete.

In the construction of many buildings, near the base thereof there is typically formed a stubby, upright stem wall which sits on top of a footing. It is usually the case that both the footing and the stem wall are formed by pouring and curing concrete, with stem-wall construction occurring via the aid of elongate, lateral construction formers (or form elements), typically wooden boards, which both define the opposite (inside and outside) sides of such a stem wall, and as well, the location for the plane of the upper surface of the stem wall.

Usually provided in and distributed along such a stem wall are plural, elongate anchor bolts whose cylindrical and threaded, upright upper ends extend above the top surface of the wall to provide tie-down or anchor points for building frame structure which is next to be built (on top of the stem wall). A mispositioned, misplaced or misangled anchor bolt presents a significant problem, inasmuch as it is usually required to be "there" in defined locations and orientations, and with a required upward projection for attachment access, in order to meet building code requirements. An improperly located, positioned or angled anchor bolt presents a problem which is costly to remedy.

People who are generally familiar with the building environment just briefly described will recognize that the activity involved in placing required anchor bolts properly can be relatively long and involved, and if not performed carefully can result in very expensive and time-consuming "rework".

The present invention addresses these matters in a very simple, practical and satisfactory manner by providing a versatile, selectively reusable jig which enables rapid, accurate placement and stabilization of anchor bolts in a wet mass of concrete (typically) which is formed and is curing as part of a construction project. Such a wet, curing mass is also referred to herein with the phrase "construction-receiving material".

Other anchor-bolt jig systems have been proposed in the past, and several of these systems are illustrated and described in the following U.S. patents whose disclosures are hereby incorporated herein by reference: U.S. Pat. No. 3,552,734 to Encino et al., U.S. Pat. No. 3,960,356 to Adams, U.S. Pat. No. 4,932,818 to Garwood, U.S. Pat. No. 5,060,436 to Delgado, Jr., U.S. Pat. No. 5,240,224 to Adams and U.S. Pat. No. 5,813,188.

These patents furnish appropriate background information and material regarding the field of the present invention. None of the devices disclosed in these several issued patents, however, offers the features that are made available by the invention.

According to a preferred embodiment of the invention, the proposed reusable anchor-bolt jig is formed of a suitable molded plastic material as a single integrated unit. It is very easily and very inexpensively so fabricated, and because of the fact that it is especially designed for long-term reusable capability, it reduces construction costs in one important sense by not having to be thrown away or destroyed after a single use.

The preferred embodiment of the invention includes an elongate, hollow, generally circular-cross-section, longitudinally slightly tapered receiver tube which has its lower, larger-diameter end joined to a generally planar base, or support footing, which includes an elongate, laterally-extending gauge finger. The upper, smaller-diameter end region of the receiver tube includes at least one, but preferably two, opposing, elongate throughwall, single-open-ended slots which offer at least two very important advantages that are made available by the present invention. One of these advantages is that this slot, or these slots, allow(s) for elastic deformation in the upper end of the receiver tube which, when utilized in an appropriately tapered structure, promotes easy, releasable gripping of the upper cylindrical, threaded end of a conventional anchor bolt within the receiver. Additionally, the one or more slots furnish(es) visual exposure of the received upper end of an anchor bolt. With such a slot (or slots) exposing the upper end extremity of an anchor bolt, and through an organization of suitable, associated linear marker structure which is presented along the side of at least one of these slots, correct vertical positioning of an anchor bolt (for example, projection from the upper surface of a stem wall) can quickly and easily be established by a construction worker. The inside surface of the receiver may, if desired, be formed with a roughened surface (surface-frictioning structure) to enhance the jig's bolt-gripping capability. Further, and also if so desired, the outer surface of the receiver tube may have a roughened quality to promote easy gripping in the field.

The extending gauge finger in the base is also preferably furnished with another suitable organization of linear marker structure. This base defines a support datum surface for the vertical placement of an anchor bolt. It does this easily and precisely with that base resting on the upper surface of, for example, a forming concrete stem wall. Marker structure in the finger can be used to define quickly and very conveniently the appropriate lateral position of an anchor bolt relative to the opposite side surfaces of a stem wall. Still further, the pre-defined angular relationship which exists in the jig between the generally planar base or footing, and the upright receiver tube, positively defines the desired correct angular orientation (typically vertical) of the upper end of an anchor bolt relative to the stem-wall mass which embeds it.

While a device built in accordance with this invention including in the base but a single extending gauge finger is entirely satisfactory in most use situations, a modified form of the invention could include, for example, another elongate, extending gauge finger aligned longitudinally with the first-mentioned finger, and disposed on the diametrally opposite side of the receiver tube.

Breakaway notches formed selectively at predetermined spatial intervals along the length of the finger allow convenient breaking-away of an outer length portion of the finger to enable use of the jig in a setting where the poured top surface of a stem wall sits below the upper edges of the usual two formers which define that wall.

When an installation is complete, and the building material (such as the concrete mass in a stem wall) has formed and hardened, it is a very simple matter to pull upwardly on the jig of this invention to free it readily and non-destructively from its associated anchor bolt, thus making the jig available handily for recurrent use. Because of the tapered configuration preferably employed in the receiver tube, plural jigs can readily be stacked-nested for convenience and compactness of transport.

Various other important features and advantages that are made available in accordance with the present invention will become more fully apparent as the description that now follows is read in conjunction with the accompanying drawings.

DESCRIPTION OF THE DRAWINGS

FIG. 4 is drawn on a larger scale than those employed in FIGS. 1–3, inclusive.

In FIG. 7, lateral formers which were used to define the pictured stem wall have been omitted.

DETAILED DESCRIPTION OF, AND BEST MODE FOR CARRYING OUT, THE INVENTION

Figure 1:
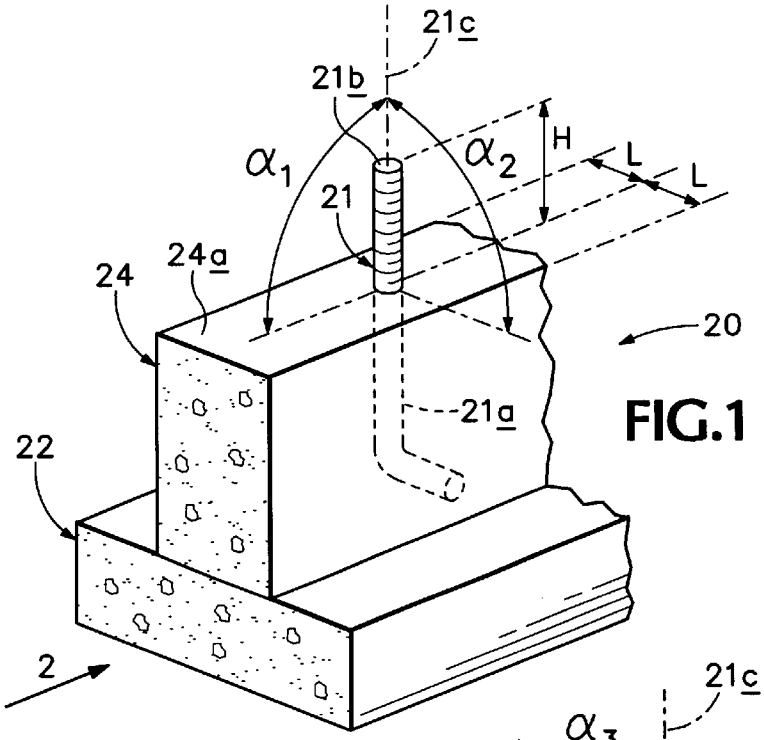
FIG. 1 is a fragmentary cross-sectional perspective view of a building installation showing a concrete footing, a concrete stem wall rising from that footing, and a single one of many used conventional anchor bolts having its upper end projecting upwardly from the top surface of the stem wall. In this figure the illustrated concrete structure has substantially cured, and the single, illustrated anchor bolt is pictured without any (now unnecessary) jig stabilizing and support structure.

Turning now to the drawings, and referring first of all to FIG. 1, here, generally indicated at 20 is a building installation involving the setting and curing of a concrete stem wall on a concrete footing. The forming stem wall is shown containing one of many conventional anchor bolts 21 whose lower ends are embedded in the stem-wall material. In FIG. 1, anchor bolt 21 is pictured is properly positioned and oriented.

Figure 8:
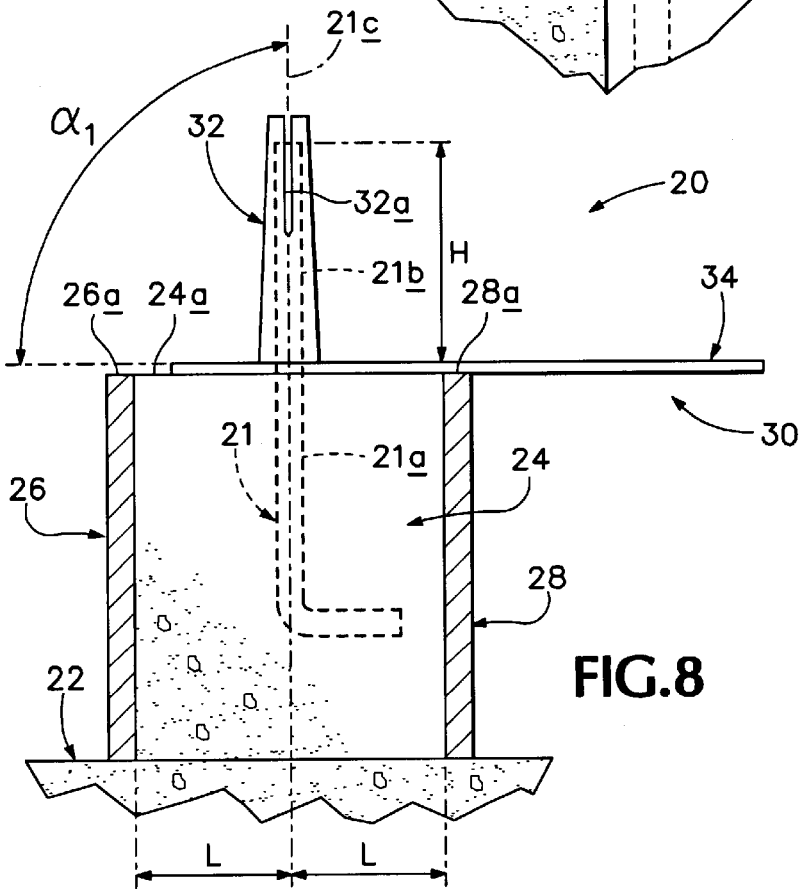
FIG. 8 is a view which is roughly drawn on the same scale that is used in FIG. 7, further illustrating, fragmentarily and in cross section, use of the gripper/stabilizer jig pictured in FIG. 7. The lateral formers employed to define the illustrated stem wall are here shown in place.

Specifically, shown generally and fragmentarily at 22 is a previously poured, and now at least preliminarily cured, concrete footing, on top of which is shown a stem wall 24. Referring briefly to FIG. 8 along with FIG. 1, the laterally opposite (inside and outside) faces of wall 24 were defined (during the pour) by two, spaced, elongate formers, such as wooden boards 26, 28 (see in FIG. 8). In the specific illustration now being given, stem wall 24 has been formed with its flat upper surface 24*a* horizontally aligned (also during the pour) with the spaced upper edges 26*a*, 28*a* of boards 26, 28, respectively (see FIG. 8).

Anchor bolt 21 is a typical one formed of steel, with a generally L-shaped (sometimes J-shaped) configuration. The lower L-shaped portion 21*a* of the anchor bolt is embedded in stem wall 24, and the upper, threaded end portion 21*b* of the bolt projects upwardly as shown from the upper surface 24*a* of the stem wall. In FIG. 1 (also in FIG. 8), anchor bolt 21 is properly positioned, in the sense that its upper end's lateral, normally centered disposition between the opposite sides of the stem wall is correct. Further, the upper "length of projection" of bolt-end 21*b* from the top surface of the stem wall is correct, as also is the overall angular disposition or orientation of this end relative to the vertical. In the instance specifically shown in FIG. 1 and now being described, the long axis 21*c* of bolt-end 21*b* is substantially vertical, and is substantially at a right angle relative to upper surface 24*a* of stem wall 24. The mentioned, correct, centered lateral position of bolt-end 21*b* is indicated generally by the arrows in FIGS. 1 and 8 associated with the letter L; the correct projection upwardly of the upper extremity of end 21*b* is pictured generally at H; and the correct angular orientation of this upper projecting end of the anchor bolt is pictured generally by the two, curved, angle-designating arrows which are marked $\alpha_1$, $\alpha_2$. While lateral centering of this bolt end between the planes of the side walls of stem wall 24 is normal, lateral off-setting may be desired in certain circumstances, and such circumstances can readily be accommodated by the jig of this invention.

Figure 2:
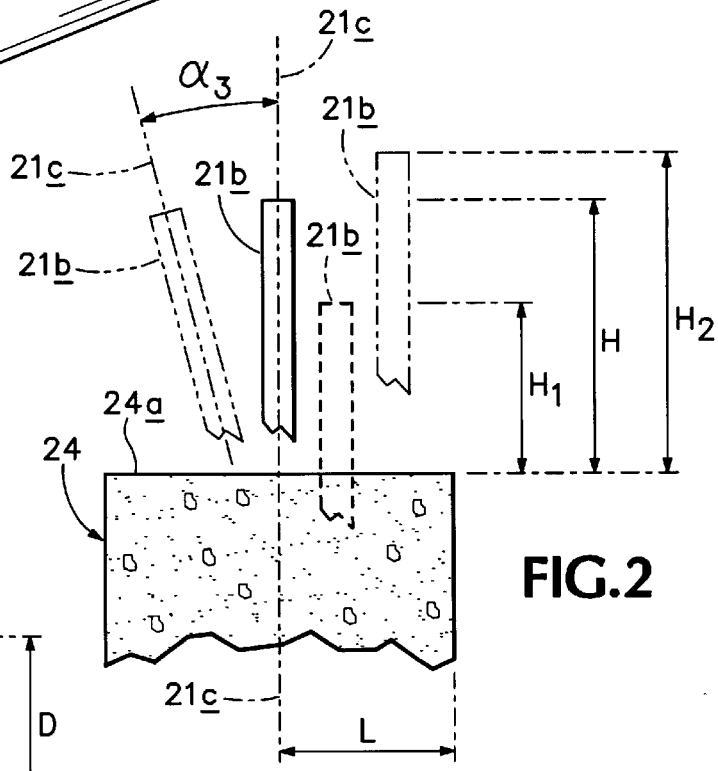
FIG. 2 is a schematic illustration, on a somewhat larger scale, fragmentary in nature, and taken generally from the point of view represented generally by the arrow 2 in FIG. 1, showing several different positions and orientations of the upper end of an anchor bolt (such as the bolt shown in FIG. 1), with some of these illustrated positions and orientations representing several different, but common, kinds of mispositioning or misorienting of such an anchor bolt.
Figure 3:
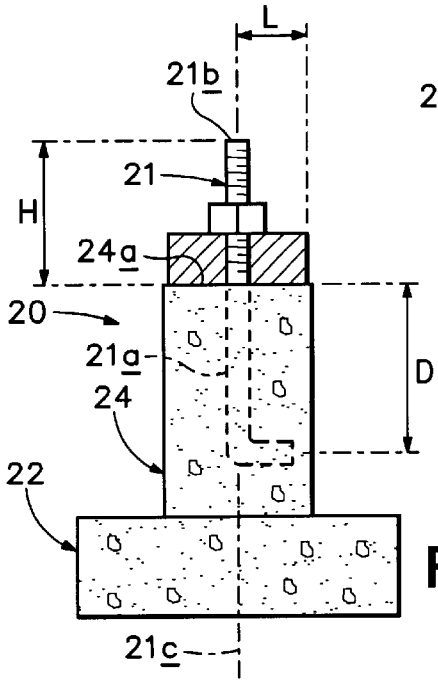
FIG. 3 is a somewhat smaller-scale view, also taken generally from the point of view of arrow 2 in FIG. 1, showing how frame structure (specifically a horizontal, elongate mud-seal element) is anchored to the stem wall of FIG. 1 utilizing properly placed and positioned anchor bolts, such as the single anchor bolt shown in this figure and in FIG. 1.

Comparing this correct positioning and orienting of anchor bolt 21 with several kinds of typical mispositioning and misorienting which can occur, and referring now to FIG. 2 along with the other two figures which have so far been discussed herein, in solid fragmentary lines in FIG. 2, the upper extremity of the upper end 21*b* in the anchor bolt is illustrated in the correct position and orientation. In dashed lines and in dash-double-dot lines in FIG. 2, this upper bolt end is pictured in two different kinds of both laterally and vertically mispositioned conditions. The dashed-line showing for bolt-end 21*b* pictures the same laterally off-center relative to the opposite sides of stem wall 24, and lower (see $H_1$) than is correct. The dash-double-dot lines pictures bolt-end 21*b* also laterally miscentered relative to the laterally opposite sides of stem wall 24, and, additionally, elevated (see $H_2$) more than it should be relative to the upper surface 24*a* of the stem wall. In dash-triple-dot lines, the upper end 21*b* in anchor bolt 21 is illustrated principally angularly misoriented relative to the vertical and to the upper surface in the stem wall. Such angular misorientation is illustrated by angle $\alpha_3$.

It should be understood that great exaggerations are displayed in the positional views pictured in FIG. 2. This has been done intentionally in order to clarify the kinds of mispositioning and misorienting which are overcome by use of the present invention.

Figure 4:
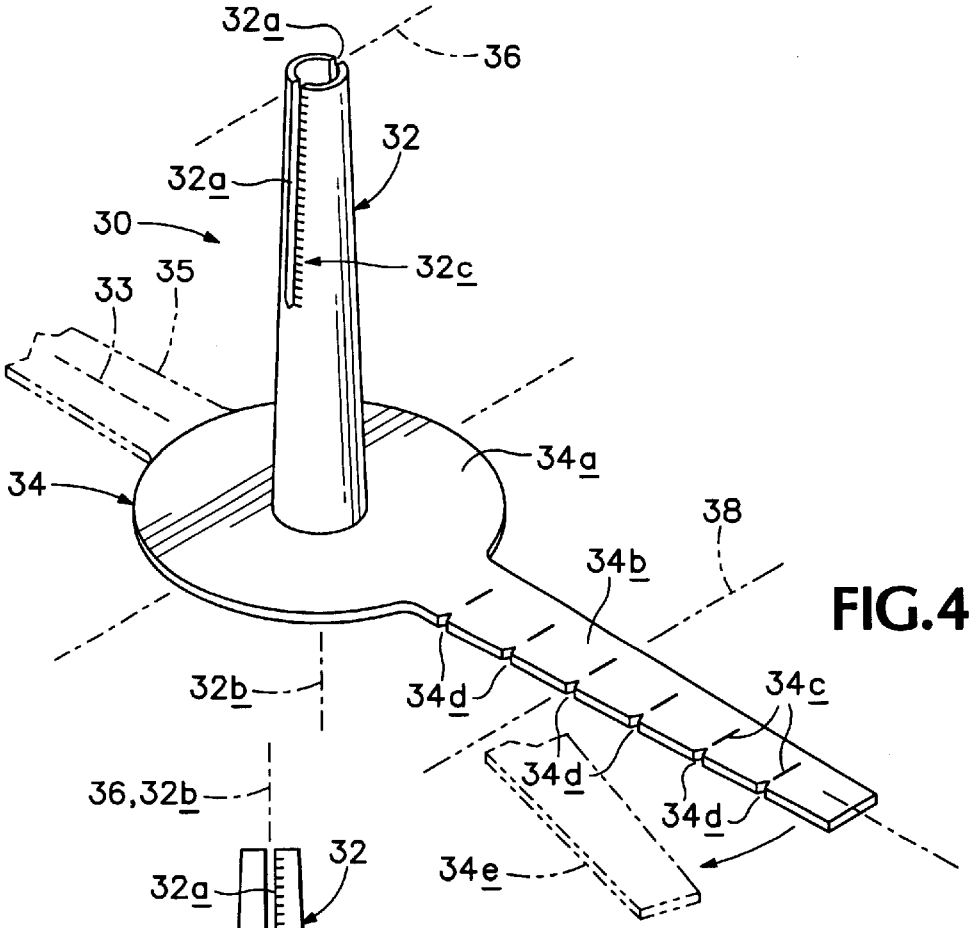
FIG. 4 is a side perspective view of a gripper/stabilizer jig which is constructed in accordance with a preferred embodiment of the present invention. At the right side of FIG. 4, and in dash-double-dot lines, there is shown an outer-end length-portion of a gauge finger in this jig which has been broken away for a certain specific use of the jig—a use that will be described more fully shortly.
Figure 5:
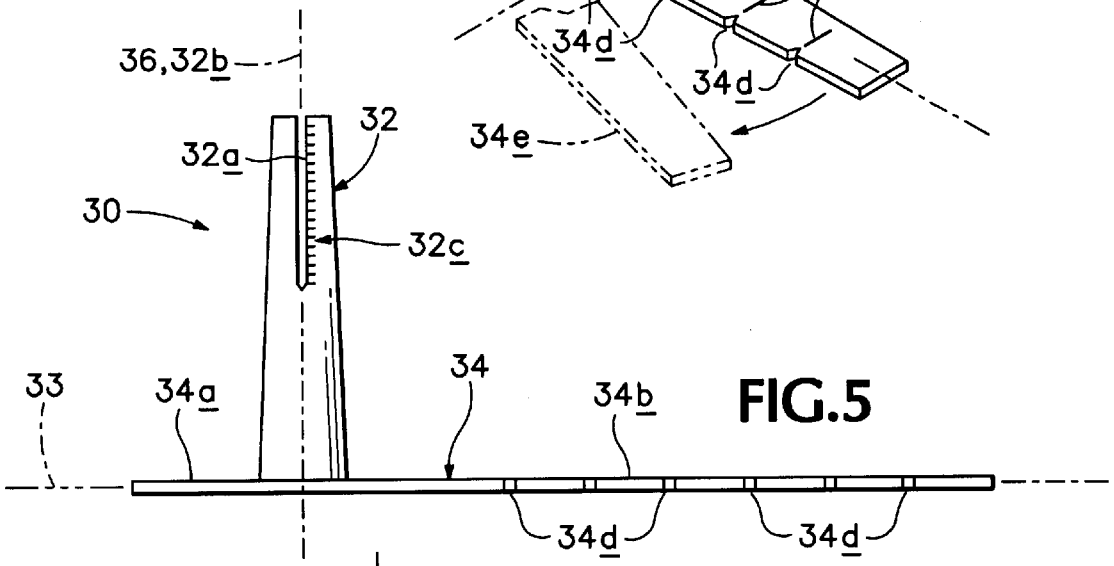
FIG. 5 is a slightly reduced-scale side elevation of the jig of FIG. 4.
Figure 6:
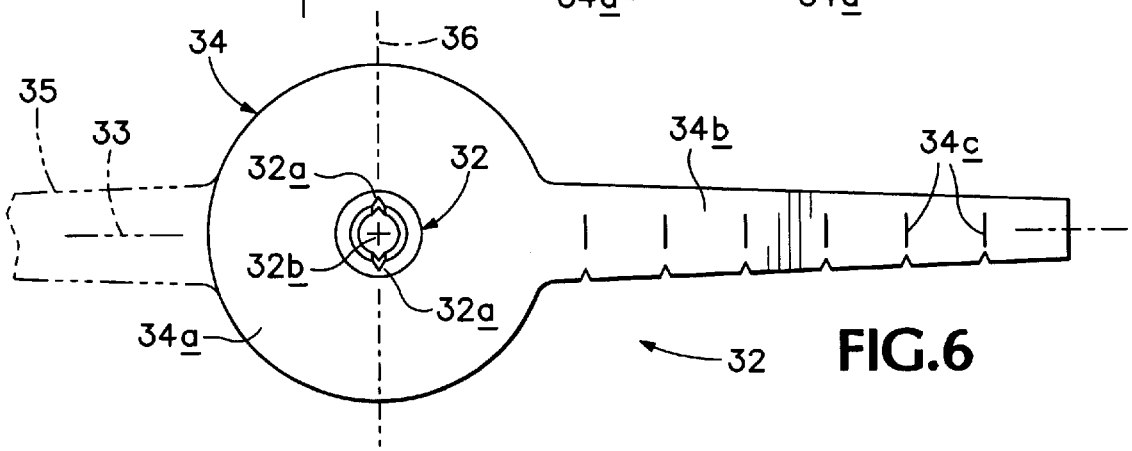
FIG. 6 is a plan view taken generally from the top side of FIG. 5.
Figure 7:
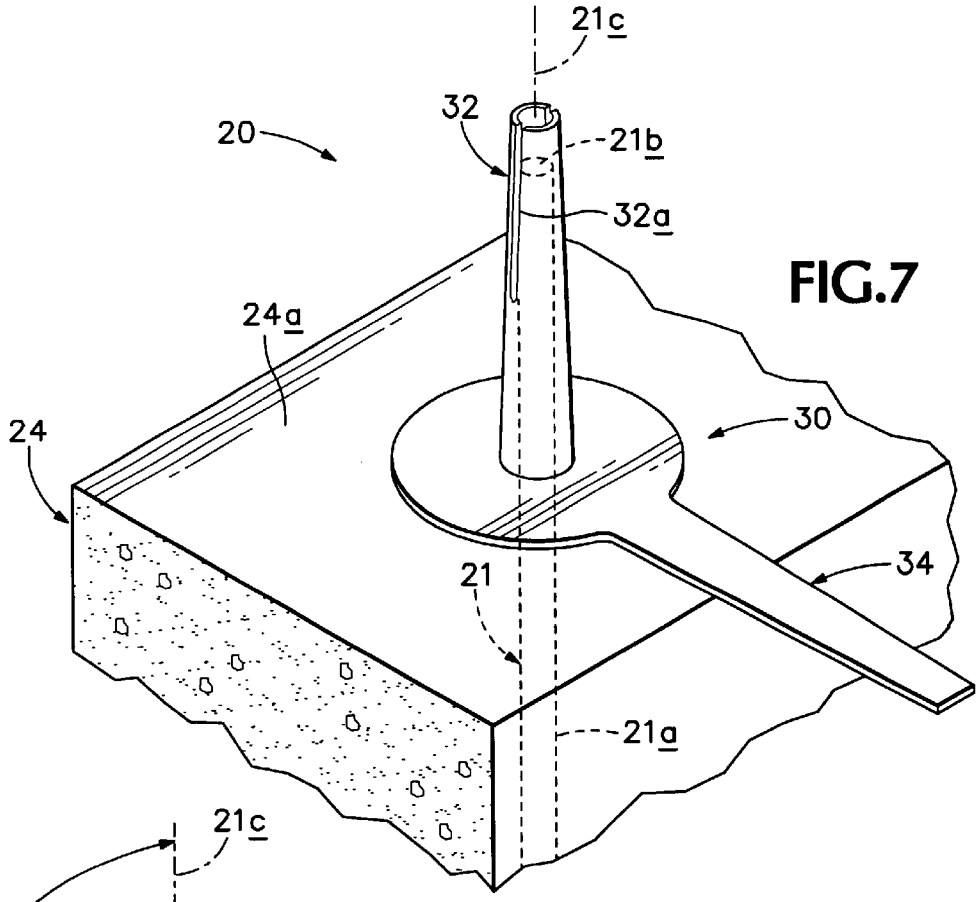
FIG. 7 is a fragmentary view, taken generally from the same point of view employed in FIG. 1, and is drawn on a larger scale than that employed in FIG. 1, generally illustrating use of the jig of FIGS. 4–6, inclusive, with respect to the installation of an anchor bolt in a stem wall.
Figure 9:
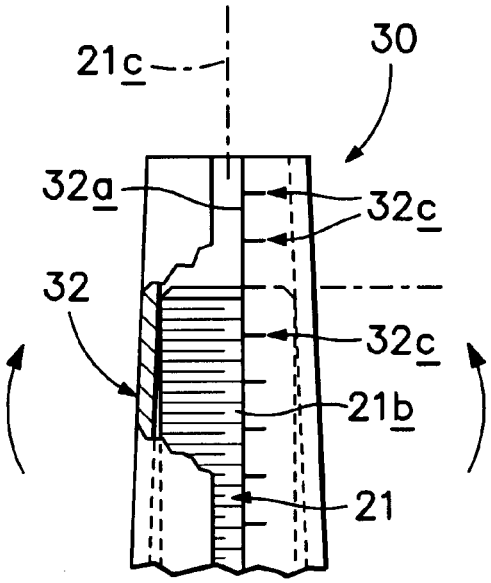
FIG. 9 is a larger-scale view, fragmentary in nature, illustrating the upper end of an elongate tapered tube or receiver which forms part of the jig pictured in FIGS. 4–8, inclusive, with portions of this jig being broken away to illustrate the presence of the upper end of a gripped/stabilized anchor bolt as such sits in that receiver.
Figure 10:
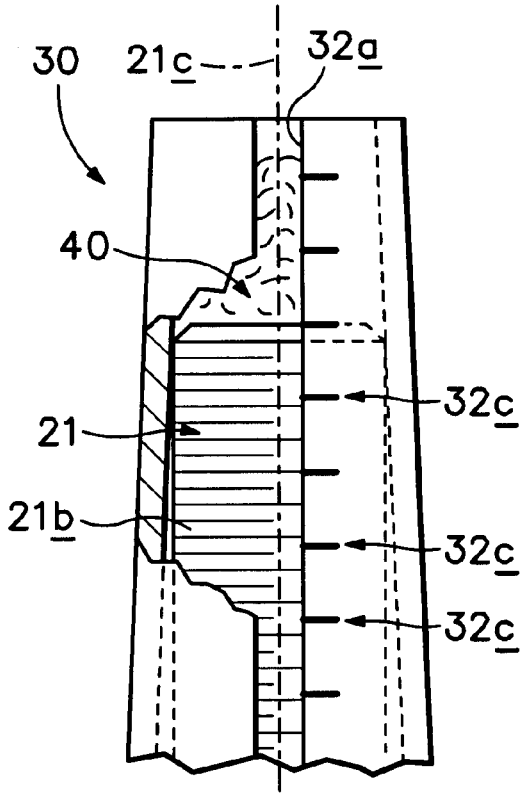
FIG. 10 is a view which is very much like that presented in FIG. 9, showing, on a significantly larger scale, essentially the same organizational arrangement pictured in FIG. 9, but here further showing a modified form of jig structure produced in accordance with the invention, wherein the receiver includes a roughened, frictioning, internal frustro-conical surface.

Turning attention now additionally to FIGS. 4–6, inclusive, as well as FIGS. 7, 9 and 10 along with FIGS. 1 and 8, according to the present invention, anchor bolt 21 has been installed during curing of stem wall 24 with the use of a stabilizing and gripping jig 30 that is built in accordance with the present invention. FIGS. 4–6, inclusive, show this jig in a condition isolated from all other structures, and FIGS. 7–10, inclusive, show the jig in use. In FIGS. 1, 2 and 7, lead line 21*b* touches what is referred to herein as the upper extremity of the upper end of bolt 21.

Jig 30, in its preferred form, has the configuration clearly illustrated in FIGS. 4–6, inclusive. This jig is preferably formed as a single, integrated unit out of a suitable molded plastic material, such as nylon. Jig 30 includes an elongate, double-open-ended, longitudinally and slightly tapered tube, or receiver, 32 which is joined to, and which projects upwardly (in FIGS. 4 and 5) from a substantially planar base 34. In the jig embodiment which is now being described, the inside diameter of tube 32 is about ½-inches at the tube's lower end, and about 29/64-inches at the upper end. In the particular form of FIG. 30 which is pictured herein, tube 32 is tapered substantially along its entire length. As was mentioned earlier, such a construction promotes compact nesting and stacking of plural jigs for low-volume, easy conveyance from job site to job site. In alternative jig configurations, tube taper might only be present in the upper portion of the tube.

The wall, or wall structure, in tube 32, which might typically have a length of about 2- to about 4-inches, is furnished with two co-planar, diametrally-opposed, single-open-ended, elongate slots 32*a* that extend downwardly from the upper end of the tube, roughly half the length of the tube toward its lower end. The plane containing slots 32*a* which slots are also referred to herein as lateral window structure, is shown in FIGS. 4–6, inclusive, by dash-dot line 36. The long axis of tube 32, shown generally at 32*b* in FIGS. 4–6, inclusive, and in FIGS. 9 and 10, is substantially normal to the plane which contains base 34.

Appropriately formed along the edge of at least one of slots 32*a* is a distribution of appropriate length markings, such being shown generally at 32*c* in FIGS. 4 and 5. These markings, also referred to herein as a first organization of marker structure, preferably indicate different distances along the length of tube 32 relative to the lower planar surface of base 34. The juxtapositional and cooperative relationship which thus exists between the open slots and marker structure 32*c* promotes reliable vertical positioning of the upper end of an anchor bolt.

Base 34 preferably has a somewhat key-shaped perimetral outline (see particularly FIG. 6), including a somewhat circular portion 34*a* from the center of which projects tube 32, and an elongate gauge finger portion 34*b* which extends radially away, along an axis 33, from one side of portion 34*a*. Base 34 herein has an overall length (see FIG. 6) preferably in the range of about 6- to about 8-inches. Finger portion 34*b* is furnished along its length with appropriate length markings, such as the markings shown at 34*c* in FIGS. 4 and 6. Markings 34*c*, also referred to herein as a second organization of marker structure, relate to selected, predetermined distances along the finger portion relative to previously-mentioned tube axis 32*b*.

Distributed along at least one edge of finger 34*b* in the jig, and positionally coincident with at least certain ones of markings 34*c* herein, are break-away-enabling, preformed notches, such as those shown at 34d in FIGS. 4–6, inclusive.

The markings along the length of finger 34*b* are employed, as will be described shortly, to control lateral positioning of the upper end of an anchor bolt relative to the opposite sides of a forming stem wall. The break-away-enabling notches just mentioned are provided to allow easy breaking away of different selected outer length portions of the finger to accommodate, as will also be described shortly, use of jig 30 in a setting where (see especially FIG. 11) the stem wall is formed during a pour with its upper surface 24*a* lying below the upper edges of former boards, such as boards 26, 28. Pictured in FIG. 4 in dash-double-dot lines toward the right side of this figure, is a length section 34*e* of finger 34*b* which is shown broken away from remaining portions of the finger. The related break has taken place along a dash-double-dot line 38 which is coincident, so-to-speak, with that notch 34*d* which is the fourth in the from the outer (right) end of finger 34*b* in FIGS. 4–6, inclusive.

Shown fragmentarily in dash-triple-dot lines in FIGS. 4 and 6, at 35, is a second elongate finger portion which may be employed in a modified form of the invention. Such an additional finger portion preferably matches in construction finger portion 34, and extends also along axis 33 on the diametrally opposite side of tube 32 relative to finger portion 34*b*. An additional finger portion, such as finger portion 35, offers an additional option for positioning a jig laterally, and also provides a larger support area for the jig on the surface of wet concrete.

Explaining now how jig 30 performs according to the invention, and beginning with the description of how the jig is used under circumstances where the top surface of a stem wall is intended to lie flush with the upper edges of former boards (see FIG. 8), a worker fits the jig onto an anchor bolt which is about to be installed in a fresh, poured stem wall, He or she does this by inserting the upper end portion of the bolt, i.e., the threaded end portion, such as portion 21*b* in bolt 21, into tube 32 from the bottom end of the tube, and by moving that bold end upwardly toward the upper end of the tube. The tube diameter, and its taper, are preferably defined in such a manner that even the shortest-projection anchor bolt which is contemplated for use will, when properly positioned relative to jig 30, have its upper end extending upwardly into the tube beyond the lower end of slots 32*c*. Such an installation will cause the portions of the tube that are on the opposite sides of slots 32*a* the slot to bend and yield outwardly to accommodate the bolt end. Such bending and yielding will result in the upper end region in tube 32 applying gripping pressure to the upper end of the bolt. Slot length preferably is chosen such that, with respect to all anchor bolts intended to be gripped and stabilized by the device of the invention, the upper ends of such bolts will nominally reside with their upper extremities clearly visible through the slots.

The bolt/jig assembly is then manipulated to drive the lower L- or J-shaped anchor-bolt end downwardly into the wet stem wall concrete. The assembly is then moved and adjusted in such a fashion that the underside of base 34*b* of the jig rests on the top surface of the curing stem wall, as well as on the upper edge of one of the two lateral formers. During this manipulation, the assembly is positioned in such a fashion that the markers along the length of finger 34*b* line up appropriately with the inner or outer surfaces of a former board in order to assure proper lateral positioning of the anchor bolt. The position of the upper extremity of the upper end of the bolt, now visible through slots 32*c,* is adjusted so that the overall upward projection of the threaded end of the bolt will be correct relative to the upper surface of the stem wall. The very fact that the bolt is gripped, as was mentioned above, within the tube in the jig, effectively causes the bolt, and more specifically the long axis of its upper end, to be properly angularly related to the vertical and to the upper surface of the forming stem wall.

It should be apparent that this operation can be performed very quickly, and with a great deal of confidence that the positioned and gripped anchor bolt will rest essentially exactly at the right location, and with the right orientation in the stem wall.

When the concrete in the stem wall has cured sufficiently, and the anchor bolts are essentially now secured in their positions along the wall, the stabilizing jigs employed according to this invention are simply lifted and removed from the upper bolt ends. If so desired, the outside surface of the receiver tubes may be appropriately roughened to facilitate such lifting and removing. The jigs are then ready for re-use in another construction project.

Figure 11:
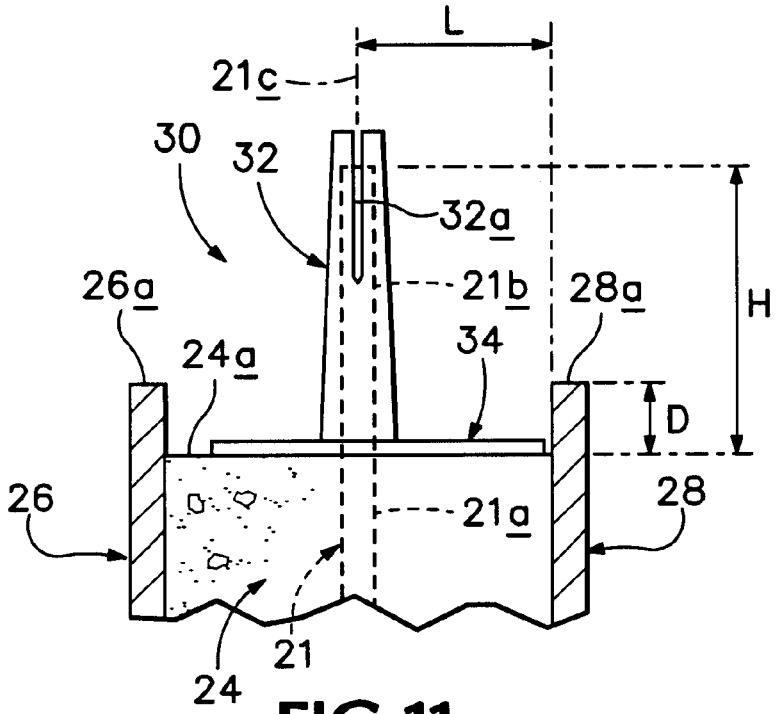
FIG. 11 is a fragmentary cross-sectional view, much like that presented in FIG. 8, but here showing use of a jig constructed in accordance with the present invention whose gauge finger has been shortened by breaking off an outer length portion of that finger (see FIG. 4) to allow use of the jig in a poured stem wall installation wherein the upper surface of the poured stem wall sits below the upper edges (or surfaces) of two lateral formers which define the stem wall.

Under circumstances where it is intended that the upper surface of a poured stem wall be formed at an elevation which is below the upper edges of lateral former boards, and here see particularly FIG. 11, in this kind of situation, the projecting finger in the jig is broken off appropriately so that the base of the jig will fit entirely within the lateral space between the former boards, and correctly on top of the surface of the curing stem wall.

While under most circumstances, it will not be necessary to furnish any frictioning or roughening surface texture to the inside of the tube in the jig in order to assure firm gripping of the upper end of an anchor bolt, such roughening texture can certainly be included by way of molding in this tube. FIG. 10 in the drawings illustrates generally at 40 such a roughened inside surface texture.

While a preferred embodiment of the jig of this invention has been described in a setting where the tube therein is furnished with a pair of diametrally opposed elongate slots, a single slot could be employed, as well as a greater number of slots, if so desired.

It should thus be apparent how the novel gripper/stabilizer jig of the present invention promotes efficient and convenient and accurate placement of anchor bolts of the type described during various construction projects. Use of the jig of this invention essentially eliminates the possibility that a placed anchor bolt will be either mispositioned or misoriented. It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A reusable jig for positioning and stabilizing an anchor bolt in wet, curing construction material in a circumstance where that material takes the form of a body of material having a generally horizontal upper surface, and two, opposite, upright side surfaces which intersect the upper surface, and which are supported between a pair of construction form elements, said jig comprising an elongate, generally round-cross-section, hollow tube formed with wall structure having (a) a lower end, (b) an upper tapered end which has, progressing upwardly in the tube away from its wall structure's said lower end, a progressively diminishing internal cross-sectional area, all regions of which are smaller in cross-sectional area than that of the upper end of any anchor bolt with respect to which the jig is intended for use, (c) a long axis extending between said ends and (d) at least one elongate slot formed in said tapered upper end, said tube being adapted reversibly to receive, and releasably to grip within its said upper end, the upper end of an anchor bolt in the anchor-bolt size range which is anticipated to be positioned and stabilized by the jig, such gripping of such a bolt being accommodated by said at least one slot which permits elastic (and thus naturally reversible) gripping deformation to occur in the tube's wall structure's said upper end, said at least one slot also affording a view from the outside of the tube to see the upper end of such a bolt in the tube, and a generally planar base joined to said tube adjacent the tube's said lower end, and lying in a plane which is at a defined and predetermined angle relative to the long axis of said tube, said base including an elongate, laterally extending gauge finger, with the base being placeable, during use of the jig, over the upper surface of the wet construction material, and with (a) positioning of said gauge finger relative to one of the two supporting construction form elements defining the lateral position of said tube, and hence of any gripped anchor bolt, relative to the opposite, upright side surfaces of the wet construction material, (b) the predetermined angle which exists between the plane of said base and the long axis of said tube defining the angular disposition of any tube-gripped anchor bolt relative to the construction material, and (c) the visible (through the slot) position of the upper end of the gripped anchor bolt defining the vertical position of the anchor bolt relative to the upper surface of the wet construction material.

2. The jig of claim 1, wherein said tube's wall structure has an outside surface, and which further includes a first organization of marker structure formed on said outside surface of said tube's wall structure's said upper tapered end and adjacent said slot, cooperating with said slot to assist in selective longitudinal positioning of the upper end of an anchor bolt within and along the tube's wall structure's upper end.

3. The jig of claim 2 which further includes a second organization of marker structure formed on said gauge finger cooperating in the use of the jig to establish the lateral position of an anchor bolt relative to the opposite upright side surfaces of the wet construction material.

4. The jig of claim 1, wherein said gauge finger includes an outer, downturned end which is selectively engageable with a construction form element to define a selected, predetermined lateral position of an anchor bolt relative to the opposite, upright side surfaces of the wet construction material.

5. The jig of claim 2, wherein said gauge finger includes an outer, downturned end which is selectively engageable with a construction form element to define a selected, predetermined lateral position of an anchor bolt relative to the opposite, upright side surfaces of the wet construction material.

6. The jig of claim 3, wherein said gauge finger includes an outer, downturned end which is selectively engageable with a construction form element to define a selected, predetermined lateral position of an anchor bolt relative to the opposite, upright side surfaces of the wet construction material.

7. The jig of claim 1 which is formed as a unitary, plastic molded structure.

8. The jig of claim 1 which further includes surface-frictioning structure formed on the inside of said tube's wall structure's said upper tapered end.

9. For use in a construction project, a reusable jig for positioning and stabilizing an anchor bolt in a wet, curing construction material, said jig comprising an elongate, hollow receiver adapted grippingly and releasably to receive the upper end of such a bolt, and including lateral window structure designed to expose a view of the relative position of the upper extremity of the upper end of such a bolt end relative to the receiver and hence to the jig, and a support footing joined to said receiver and having a lower, generally planar surface which is effective for placing the jig, and any received anchor bolt, in a defined installation disposition relative to the mentioned construction material, which disposition is characterized by a defined lateral position and a defined angular orientation, said receiver and footing, under circumstances associated with such a construction project releasably holding and stabilizing a received and gripped anchor bolt in such a defined dispostion.

10. The jig of claim 9, wherein said receiver has upper and lower ends, said footing is disposed adjacent the receiver's said lower end, and said lateral window structure takes the form of an elongate, single-open-ended slot which extends in the receiver from a region intermediate the receiver's said upper and lower ends to the receiver's said upper end.

11. An anchor-bolt gripper/stabilizer usable in an installation procedure involving placement of an upright, elongate construction anchor bolt in a fluid, but curing, construction material, said gripper/stabilizer comprising an elongate hollow tube adapted releasably to receive and grip the upper end of such a bolt in a manner enabling precise, selectable, infinitely adjustable longitudinal positioning of that upper end within said tube, window structure formed in said tube, offering visibility of the position of the upper extremity of such a bolt upper end in the tube, and support datum structure joined to said tube and in a fixed configurational relationship therewith, operable during a bolt-installation procedure, to support the tube, and through the tube, to support any received and gripped anchor bolt, in a condition with that bolt having a defined and controlled (a) lateral position, (b) vertical position and (c) angular orientation, relative to the mentioned construction-receiving material.

* * * * *

UNITED STATES PATENT AND TRADEMARK OFFICE

CERTIFICATE OF CORRECTION

PATENT NO. : 6,431,517 B1
DATED : August 13, 2002
INVENTOR(S) : Chapman

It is certified that error appears in the above-identified patent and that said Letters Patent is hereby corrected as shown below:

Title page,
Item [76], should read:
-- Inventor: William Grant Chapman
Boardman, Oregon 97818 --

Signed and Sealed this

Twenty-sixth Day of July, 2005

JON W. DUDAS
*Director of the United States Patent and Trademark Office*